United States Patent [19]

Parker et al.

[11] 4,162,157

[45] Jul. 24, 1979

[54] SECONDARY HARDENING STEEL HAVING IMPROVED COMBINATION OF HARDNESS AND TOUGHNESS

[75] Inventors: Earl R. Parker, San Leandro; Victor F. Zackay; Manjeshwar S. Bhat, both of Berkeley; Warren M. Garrison, Jr., Oakland, all of Calif.

[73] Assignee: The United States of America as represented by the United States Department of Energy, Washington, D.C.

[21] Appl. No.: 906,308

[22] Filed: May 15, 1978

[51] Int. Cl.[2] ..... C22C 38/02; C22C 38/06

[52] U.S. Cl. ..... 75/124; 75/123 K; 75/123 L; 75/123 J; 75/128 C; 75/128 W; 148/36

[58] Field of Search ..... 75/124, 123 K, 123 L, 75/123 J, 128 V, 128 W, 128 C; 148/36

[56] References Cited

U.S. PATENT DOCUMENTS

| | | | |
|---|---|---|---|
| 2,478,724 | 8/1949 | Trantin, Jr. | 75/124 |
| 2,708,159 | 5/1955 | Foley et al. | 75/124 |
| 2,715,576 | 8/1955 | Payson et al. | 75/124 |
| 2,763,544 | 9/1956 | Wagner | 75/124 |
| 3,198,630 | 8/1965 | Tarwater | 75/124 |
| 3,326,675 | 6/1967 | Kenneford | 75/124 |
| 3,431,101 | 3/1969 | Kunitake et al. | 75/124 |
| 3,492,116 | 1/1970 | Kenneford et al. | 75/124 |

*Primary Examiner*—Arthur J. Steiner

*Attorney, Agent, or Firm*—R. S. Gaither; William S. Bernheim; Irene S. Croft

[57] ABSTRACT

A secondary hardening alloy steel composition consisting essentially of about 0.25–0.5% carbon, about 0.5–1.0% manganese, about 1.5–3.0% nickel, about 0–1.0% chromium, about 1.75–2.5% molybdenum, about 0–0.4% vanadium, and an additive selected from about 1–3% aluminum and a combination of at least about 1% aluminum and at least about 1% silicon for a combined Al+Si content of about 2–4%, the balance being iron and impurity elements. The present steel composition has the following characteristics: it exhibits a flat tempering response, it is hardenable upon tempering to a Rockwell C hardness of at least 50, and it has an improved combination of hardness vs. toughness properties after tempering in the secondary hardening range. A method of preparation is also described.

8 Claims, 5 Drawing Figures

SECONDARY HARDENING STEEL HAVING IMPROVED COMBINATION OF HARDNESS AND TOUGHNESS

BACKGROUND OF THE INVENTION

The invention described herein was made at the Lawrence Berkeley Laboratory under United States Department of Energy Contract No. W-7405-ENG-48 with the University of California.

This invention relates to a secondary hardening alloy steel having an improved combination of hardness and toughness properties, and the method of preparation thereof.

The in-service operating conditions of coal transport and fragmentation equipment involve various combinations of dry or liquid slurry abrasion, impact loading, and temperatures that may vary from ambient to elevated (500° F.–1000° F.). The need exists for a relatively low cost wear resistant alloy steel for such applications, particularly for abrasive wear situations where the application involves the use of elevated temperatures or where surface temperatures in certain situations are increased drastically by friction and plastic deformation. Thus, a steel having a reduced alloying element (to reduce cost) without loss of hardness and impact toughness is desired.

Most steels become progressively softer as the tempering temperature is increased. However, a certain class of steels, known in the art as "secondary hardening" steels, regain hardness at higher tempering temperatures by the precipitation of secondary carbides. This secondary hardening response generally begins about 450° C. and drops off beyond 600° C. The tempering temperature range in which this increase in hardness occurs is referred to in the art as the "secondary hardening range". Some elements which form secondary carbides are Mo, Cr, W and V. Most secondary hardening steels exhibit a drop in hardness in the tempering range from 200° C. to 400° C., which is a disadvantage for certain abrasive wear applications. Furthermore, the precipitation of the secondary carbides may cause embrittlement with concomitant loss of toughness.

The following patents describe alloy steel containing various combinations of alloying elements including aluminum and silicon: Foley et al, U.S. Pat. No. 2,708,159, May 10, 1955; Payson et al, U.S. Pat. No. 2,715,576, Aug. 16, 1955; Wagner, U.S. Pat. No. 2,763,544, Sept. 18, 1956; Tarwater, U.S. Pat. No. 3,198,630, Aug. 3, 1965; Kenneford, U.S. Pat. No. 3,326,675, June 20, 1967; Kunitake et al, U.S. Pat. No. 3,341,101, Mar. 4, 1969; and Kenneford et al, U.S. Pat. No. 3,492,116, Jan. 20, 1970.

Foley et al (U.S. Pat. No. 2,708,159) describe an age-hardenable steel containing over 3.5% nickel in order to provide for the formation of the intermetallic compound NiAl, which is the primary hardening mechanism. The hardness levels of the described steels are relatively low, being not over 47 Rockwell C.

Payson et al (U.S. Pat. No. 2,715,576) also describe an age-hardenable steel. The described steels have hardness levels not over 48 Rockwell C, with a V-notch Izod impact value of only 5 ft. lbs. at the $R_C=48$ level.

Wagner (U.S. Pat. No. 2,763,544) discloses steel compositions which are ferritic and/or pearlitic in structure. Such steels are known in the art to be relatively soft.

The steel compositions disclosed by Tarwater (U.S. Pat. No. 3,198,630) have a relatively high (over 3% nickel) content and a low (0–0.5%) molybdenum content. The described steels are not secondary hardening steels.

Kenneford (U.S. Pat. No. 3,326,675) describes steel compositions containing 1–3% copper with only residual amounts of nickel. Copper is an expensive alloying element and difficulties have been encountered in melting copper containing alloy steels.

The steel compositions described by Kunitake et al (U.S. Pat. No. 3,341,101) have insufficient secondary carbide formers to be considered secondary hardening steels. The described steels have relatively low hardness levels, below 36 Rockwell C.

Kenneford et al (U.S. Pat. No. 3,492,116) disclose steel compositions containing only residual amounts of nickel. As evidenced by the specific examples given therein, the described steels do not exhibit a flat tempering response.

The copending application of Earl R. Parker et al, Ser. No. 773,361, filed Mar. 1, 1977, for "Ultrahigh Strength Steels Having Improved Fracture Toughness" describes AISI 4340-type steels modified by Al+Si additions to improve fracture toughness. The steels described therein are not secondary hardening steels and become progressively softer as the tempering temperature is increased beyond 400° C.

SUMMARY OF THE INVENTION

The present invention provides a secondary hardening alloy steel having improved combinations of hardness versus toughness by means of composition and microstructural control. The alloy steel composition of this invention consists essentially of about 0.25–0.5% carbon, about 0.5–1.0% manganese, about 1.5–3.0% nickel, about 0–1.0% chromium, about 1.75–2.5% molybdenum, about 0–0.4% vanadium, and an additive selected from the group consisting of about 1–3% aluminum and a combination of at least about 1% aluminum and at least about 1% silicon for a combined Al+Si content of about 2–4%, the balance being iron and impurity elements. The present steel composition exhibits a flat tempering response, is hardenable upon tempering to a Rockwell C hardness of at least 50, and has an improved combination of hardness vs. toughness properties after tempering in the secondary hardening range. Charpy V-notch impact values ($C_v$) of at least about 15 ft-lbs. have been achieved, corresponding to a hardness of $R_C55$, after tempering in the secondary hardness range. The preferred steel compositions are those containing a combination of aluminum and silicon as specified.

The present invention also contemplates a method for preparing a secondary hardening steel which has improved hardness and toughness properties. The present method involves solution treating an alloy steel composition as defined above at a temperature sufficiently high above the austenite transformation temperature to preclude ferrite formation, quenching to form essentially martensite, and then tempering at a temperature in the secondary hardening range. The present improved steels are obtainable solely by the aforementioned austenitizing, quenching, and tempering steps; no additional treatment such as ausforming or age-hardening is required.

It is, therefore, an object of this invention to provide a secondary hardening alloy steel having an improved combination of hardness versus toughness properties.

It is another object of this invention to provide a secondary hardening alloy steel composition which exhibits a flat tempering response.

Another object of this invention is to provide a secondary hardening alloy steel composition which is hardenable on tempering to an improved degree.

A further object of this invention is to provide a relatively low cost alloy steel useful for abrasive wear applications.

Yet another object of this invention is to provide a method for preparing a secondary hardening alloy steel having improved hardness and toughness properties.

Other objects and advantages will become apparent from the following detailed description made with reference to the accompanying drawings.

DETAILED DESCRIPTION OF THE INVENTION

Figure 1:
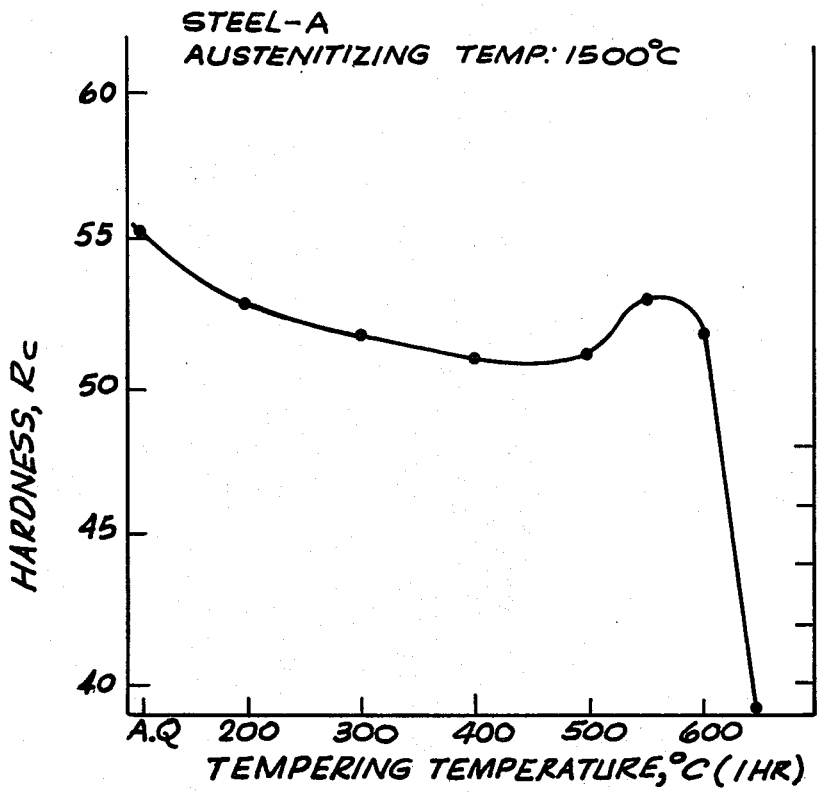
FIG. 1 is a graph of hardness ($R_C$) versus tempering temperature for a particular steel composition of the present invention, designated as A, wherein the additive is 2% aluminum.

The improved steel of the present invention is achieved by a combination of composition and microstructural control through heat treatment. The steel composition of the present invention contains as critical and essential elements about 0.25–0.5% carbon, about 0.5–1.0% manganese, about 1.5–3.0% nickel, and an additive selected from the group consisting of about 1–3% aluminum and a combination of at least about 1% aluminum and at least about 1% silicon for a combined Al+Si content of about 2–4%, the balance being iron and impurity elements. For optimum properties, it is preferred to use as the additive a combination of Al+Si. Further improvement is obtained by the inclusion of a minor amount, up to about 0.4%, of vanadium and/or a minor amount, up to about 1.0%, of chromium.

The improved steels of the present invention are obtained by a relatively simple heat treatment. An alloy steel composition as hereinbefore specified is solution treated at a temperature sufficiently high above the austenite transformation temperature to preclude ferrite formation and to obtain either no undissolved alloy carbides or a very fine dispersion of undissolved alloy carbides. Optimum properties are obtained by using a solution treating temperature in the range of 900°–1200° C. The austenitized steel is then quenched, preferably by oil quenching, to transform the steel to an essentially martensitic structure. The quenched steel is then tempered by heat treating at a temperature in the secondary hardening range, generally for at least about one hour. The secondary hardening range is generally in the range of about 525° C. to about 575°–600° C., depending upon the particular steel composition used. The resulting tempered martensitic steel has a Rockwell hardness of at least 50. Charpy V-notch impact values of at least 15 ft-lbs. (corresponding to $R_C55$) are also obtained.

In the present steel compositions, molybdenum and vanadium function as secondary carbide formers. The addition of vanadium also extends the temperature (to about 600° C.) beyond which there is a sharp drop off in hardness. The nickel content functions to counteract the effect of the ferrite stabilizers Si, Al, Mo and V. The presence of the nickel expands the austenite phase field so that austenitizing can be accomplished in the range of about 900°–1200° C. It is preferred to austenitize below 1250° C. since austenitization at higher temperatures leads to a large grain size which severely impairs impact toughness. The addition of chromium insures sufficient hardenability to obtain a fully martensitic structure by oil quenching, which is the preferred method of quenching. Manganese is present in the steel for desulfurization purposes; it is also effective for improving the hardenability of the steel.

As hereinbefore stated, most secondary hardening steels exhibit a drop in hardness in the tempering range from 200° C. to 400° C. which is a disadvantage for applications involving elevated temperatures. It has now been found that the addition of about 1–3% aluminum has the effect of "flattening" the tempering response. Herein, the term "flat tempering response" is defined as the property of maintaining a substantially constant average hardness ($R_C \pm 1$) in the tempering temperature range of 200° C. to at least 550° C. It has also been found that greater improvement is obtained by adding a combination of at least about 1% Al and at least about 1% Si for a combined Al+Si total of about 2–4%. The effect of adding Al+Si was found to be more potent than the effect of Al additions alone. It has also been found that the addition of Al or Al+Si increases the hardness levels while retaining adequate toughness. In addition, the secondary hardness peak is shifted to lower tempering temperatures and the peak hardness is significantly raised. While the exact mechanism behind the effect of the addition of Al or Al+Si is not known, it is believed that it may be due to the fact that the addition of Al and Si slows the formation and growth of cementite. And it is believed that this finer dispersion of cementite helps to maintain the hardness in the intermediate tempering temperature range. This finer distribution of the iron carbide can lead to a finer distribution of the alloy carbides in the secondary hardening range, leading to higher hardness levels.

The present invention is illustrated by the following examples. The nominal chemical compositions of exemplary steels in accordance with the present invention are given in the following table. Also listed is the nominal chemical composition of a secondary hardening steel without aluminum or silicon.

Nominal Chemical Compositions of Steels

| | Composition, Wt. Pct. | | | | | | | |
|---|---|---|---|---|---|---|---|---|
| | C | Mn | Si | Al | Cr | Mo | V | Ni |
| A | 0.35 | 0.5 | — | 2 | 1 | 2 | — | 3 |

-continued

| Nominal Chemical Compositions of Steels | | | | | | | | |
|---|---|---|---|---|---|---|---|---|
| | Composition, Wt. Pct. | | | | | | | |
| | C | Mn | Si | Al | Cr | Mo | V | Ni |
| B | 0.35 | 0.5 | 1 | 1 | 1 | 2 | — | 3 |
| C | 0.35 | 0.5 | 1 | 1 | 1 | 2 | 0.25 | 3 |
| D | 0.35 | 0.5 | 1.5 | 1.5 | 1 | 2 | — | 3 |
| E | 0.35 | 0.5 | — | — | 1 | 2 | — | 3 |

The above steels were cast into ingots, homogenized and forged and then austenitized for one hour and oil quenched. Oil quenching is preferred over ice-brine quenching in order to avoid quench cracking. The test results are shown graphically in FIGS. 1 through 5.

As shown in FIG. 1, steel A, which contains 2% Al maintains substantially constant average hardness in the tempering temperature range between 200° C. and 600° C. By comparison, steel E, a secondary hardening alloy steel containing no Al or Si (FIG. 5) exhibits a substantial drop in hardness after 200° C. and hardness at the secondary hardness peak is less than 50 Rockwell C.

Figure 2:
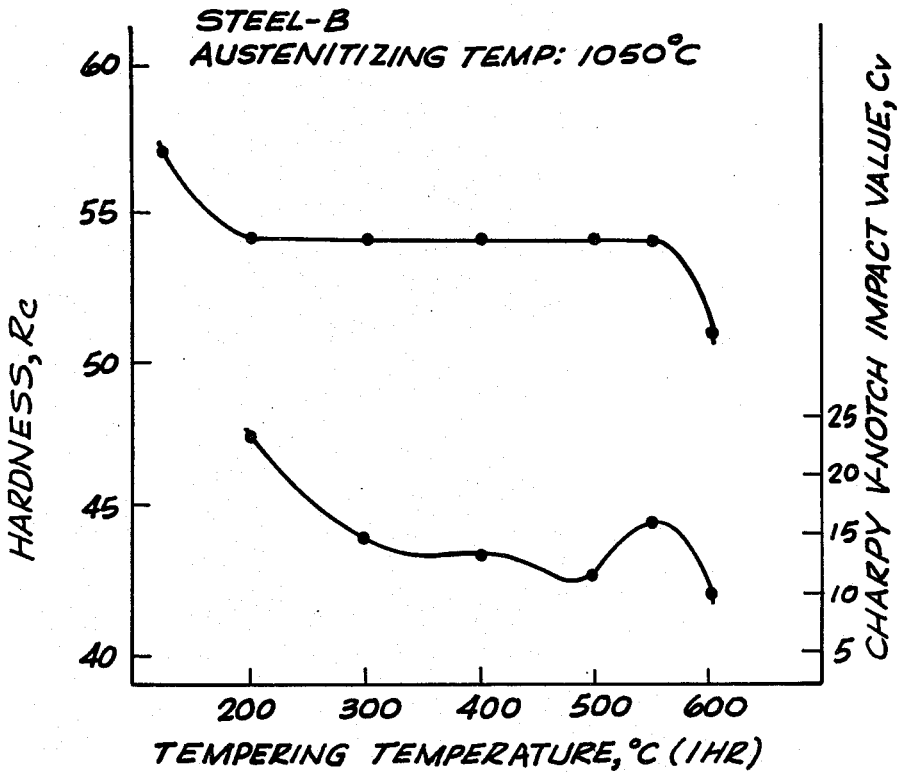
FIG. 2 is a graph of hardness ($R_C$) and Charpy V-notch impact values ($C_v$) versus tempering temperature for a particular steel composition of the present invention, designated as B, wherein the additive is 1% Al+1% Si.

FIG. 2 shows that significant improvement, with respect to "flat tempering response", is obtained by the use of a combination of Al+Si (steel B). With steel B, a Charpy V-notch impact value of over 15 ft-lbs. is obtainable by tempering at the secondary hardness peak.

Figure 3:
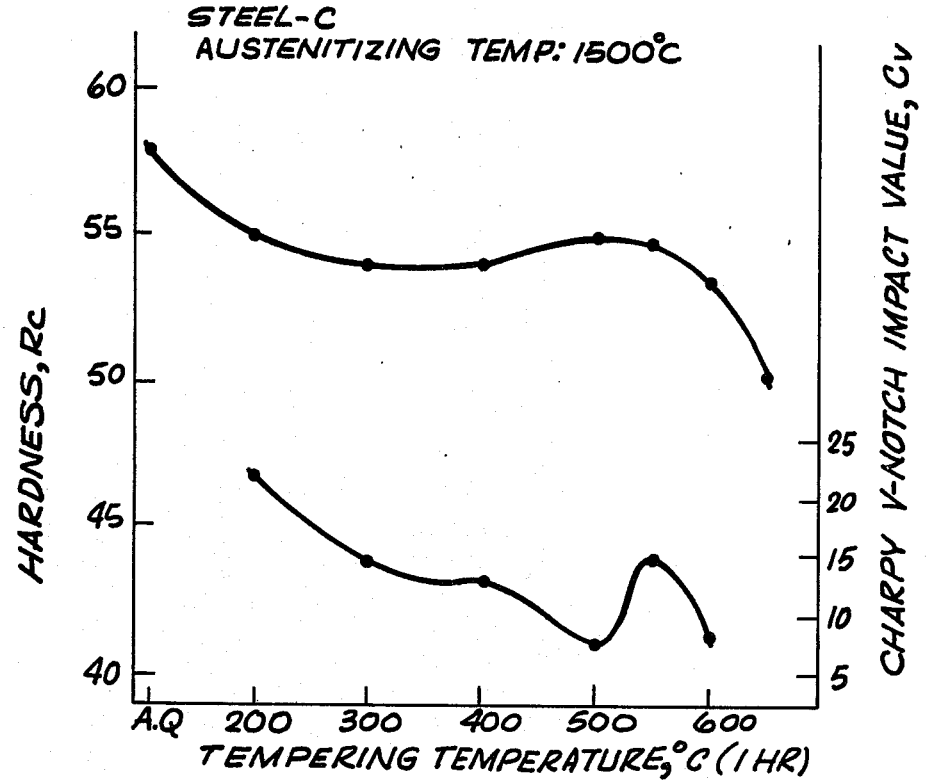
FIG. 3 is a graph of hardness ($R_C$) and Charpy V-notch impact values ($C_v$) versus tempering temperature for another particular steel composition of the present invention, designated as C, wherein the additive is 1% Al+1% Si+0.25% V.

As shown in FIG. 3, the addition of a minor amount of vanadium to a steel of composition as in steel B extends the temperature beyond which there is a sharp drop off in hardness.

Figure 4:
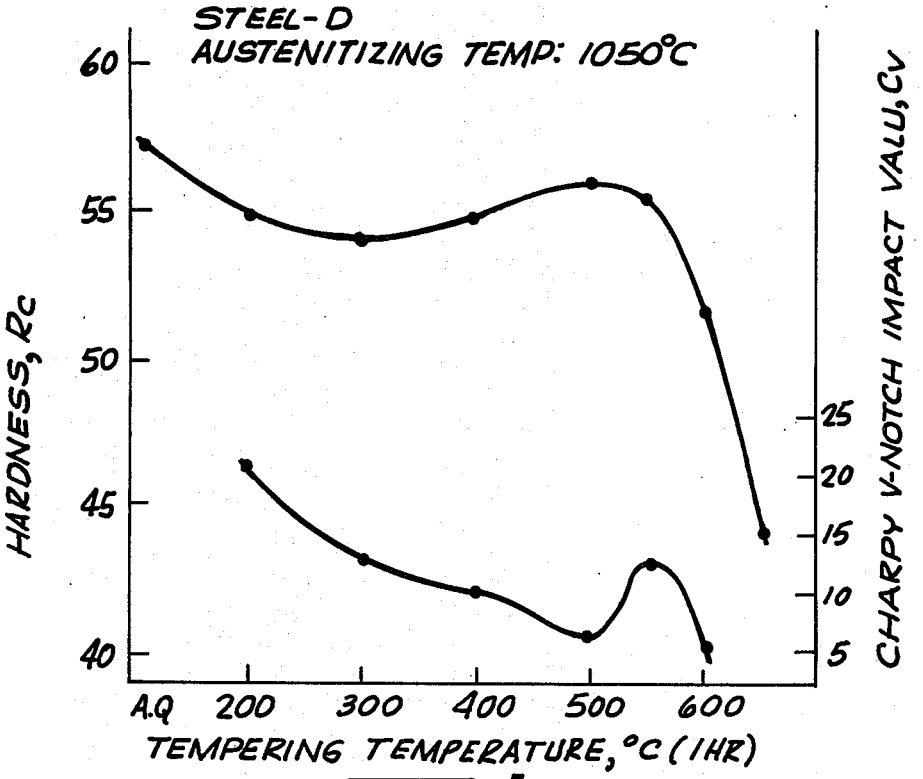
FIG. 4 is a graph of hardness ($R_C$) and Charpy V-notch impact values ($C_v$) versus tempering temperature for a particular steel composition of the present invention, designated as D, wherein the additive is 1.5% Al+1.5% Si.
Figure 5:
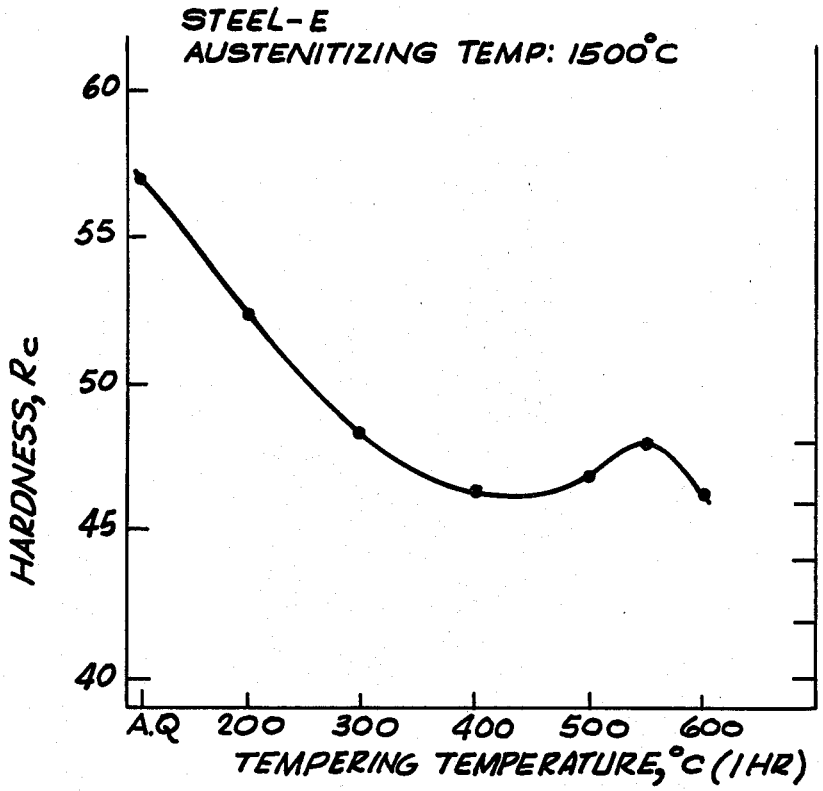
FIG. 5 is a graph of hardness ($R_C$) versus tempering temperature for a secondary hardening steel composition, designated as E, containing no aluminum or silicon.

FIG. 4 shows the test results for a steel containing 1.5% Al+1.5% Si (steel D). As is evident from the figure, steel D is hardenable to more than 55 $R_C$, with a corresponding Charpy V-notch value of about 12 ft-lbs.

It is evident from the test results shown in the accompanying figures that the steels of the present invention have improved hardness and toughness properties. Furthermore, these improved properties are obtained using a relatively low alloy content and a relatively simple heat treatment which are factors that contribute to reduced costs.

Although specific embodiments of the invention have been described hereinbefore, it will be appreciated that various modifications and changes can be made without departing from the true spirit of the invention.

What we claim is:

1. A secondary hardening alloy steel composition consisting essentially of about 0.25–0.5% carbon, about 0.5–1.0% manganese, about 1.5–3.0% nickel, about 0–1.0% chromium, about 1.75–2.5% molybdenum, about 0–0.4% vanadium, and an additive selected from about 1–3% aluminum and a combination of at least about 1% aluminum and at least about 1% silicon for a combined Al+Si content of about 2–4%, the balance being iron and impurity elements.

2. A secondary hardening alloy steel composition as in claim 1 wherein said composition is characterized by a flat tempering response, being hardenable on tempering to a hardness of at least 50 Rockwell C, and improved hardness versus toughness properties after tempering in a secondary hardening temperature range of between about 450° and about 600° C.

3. A secondary hardening alloy steel composition as in claim 1 wherein said additive is about 1–3% aluminum.

4. A secondary hardening alloy steel composition as in claim 1 wherein said additive is a combination of at least about 1% aluminum and at least about 1% silicon for a combined Al+Si content of about 2–4%.

5. A secondary hardening tempered martensitic alloy steel having a composition consisting essentially of about 0.25–0.5% carbon, about 0.5–1.0% manganese, about 1.5–3.0% nickel, about 0–1.0% chromium, about 1.75–2.5% molybdenum, about 0–0.4% vanadium, and an additive selected from the group consisting of about 1–3% aluminum and a combination of at least about 1% aluminum and at least about 1% silicon for a combined Al+Si content of about 2–4%, the balance being iron and impurity elements, said steel having a Rockwell C hardness of at least 50.

6. A secondary hardening tempered martensitic alloy steel as in claim 5 wherein said alloy steel has a Charpy V-notch impact value of at least about 15 foot-pounds.

7. A secondary hardening tempered martensitic alloy steel as in claim 5 wherein said additive is about 1–3% aluminum.

8. A secondary hardening tempered martensitic alloy steel as in claim 5 wherein said additive is a combination of at least about 1% aluminum and at least about 1% silicon for a combined Al+Si content of about 2–4%.

* * * * *